US006142712A

United States Patent [19]

White et al.

[11] Patent Number: 6,142,712

[45] Date of Patent: Nov. 7, 2000

[54] HOLLOW SCREW-IN PILE

[76] Inventors: Richard White, 10020 Fairmount Drive S.E., Alberta Calgary, Canada, T2J 0S7; Ted Krossa, 50 - 28364 TWP Road 384, Red Deer County, Alberta, Canada, T4S 2B5; Charles Jones, 63 - Lambert Circle, St. Albert, Canada, T8N 1M3

[21] Appl. No.: 09/017,726

[22] Filed: Feb. 3, 1998

[51] Int. Cl.[7] ..... E02D 7/28

[52] U.S. Cl. ..... 405/249; 175/220

[58] Field of Search ..... 405/225, 228, 405/249, 251, 253, 232; 52/726.1; 175/220, 253, 257

[56] References Cited

U.S. PATENT DOCUMENTS

| | | | |
|---|---|---|---|
| 286,599 | 10/1883 | Fitzgerald | 175/220 X |
| 2,023,966 | 12/1935 | Montee | 405/249 |
| 2,191,248 | 2/1940 | Cappel | 405/216 |
| 2,743,585 | 5/1956 | Berthet et al. | 74/61 |
| 2,897,553 | 8/1959 | Gorrow | 52/723.2 |
| 3,123,163 | 3/1964 | Overby | 175/220 X |
| 3,436,921 | 4/1969 | Gauntt, Jr. et al. | 405/249 |
| 3,525,224 | 8/1970 | Bardgette | 405/225 |
| 3,851,483 | 12/1974 | Holley, Jr. | 405/232 |
| 4,618,287 | 10/1986 | Kinnan | 405/232 |
| 4,621,950 | 11/1986 | Kinnan | 405/231 |
| 4,697,649 | 10/1987 | Kinnan | 175/19 |
| 4,983,072 | 1/1991 | Bell, Jr. | 405/216 |
| 5,066,168 | 11/1991 | Holdeman | 405/249 |

*Primary Examiner*—David Bagnell
*Assistant Examiner*—Tara L. Mayo
*Attorney, Agent, or Firm*—Thomas E. Malyszko

[57] ABSTRACT

A pile is provided for installing poles in loose soils such as marshes, muskegs or granular soils. The pile is hollow, cylindrical and open-ended. It uses a serrated bottom end for cutting through the ground, and has retainment slots at its top end for slidably engaging a spinner bar for rotating the pile. The pile may be used with an auger to enhance ground penetration during installation of the pile. The pile is modularly extendible in lengths to thirty feet or more. The pile is twisted into the ground using high-torque hydraulically driven digger motors mounted on commercially available construction equipment.

17 Claims, 6 Drawing Sheets

HOLLOW SCREW-IN PILE

FIELD OF THE INVENTION

The present invention relates to ground supports or foundations for posts generally, and in particular relates to a hollow pile for supporting a post in various types of ground conditions such as sandy soils, peats, marshes, muskegs and the like.

BACKGROUND OF THE INVENTION

It is difficult to place and support a post, pole or other like slender object (referred to herein collectively as a "post" for ease of reference) into certain types of ground or soil conditions. Particularly problematic are the loose or "cohesion-less" soils, such as sand or loose aggregate, as well as ground with a high liquid content, such as swamps, peat bogs and marshes. In such ground conditions problems arise with insertion of the post into the ground and inadequate support for the post upon insertion. Post-receiving holes dug in sandy soils tend to collapse into themselves, requiring the removal of large volumes of soil to achieve a desired depth of hole, which soil must then be replaced about the post upon insertion. Opening a post-receiving hole in marshy conditions is typically impossible because of the fluidity of the material. Another drawback in such ground conditions are the additional supports that must often be provided to hold the post upright upon insertion.

The above noted problems are often encountered with the installation of utility posts in northern Canada in the large tracts of marshy land known as "muskegs", shown in FIG. 1. A muskeg typically has a top layer 16 (commonly a foot to several feet deep) of firm decomposed organic matter that "floats" on a marshy material 17 (up to 30 feet deep) which itself sits over an impermeable base such as clay. The vertical post 10 can not be supported by the relatively soft organic top layer 16 nor the marshy material 17 alone, and either the post is too short for insertion into the relatively firm clay base or it would be impractical to do so. Hence, a "ship's mast" method of supporting the vertical post is typically used where the post is sunk about six feet into the muskeg and a pole 12 is bolted generally perpendicularly to the post 10 at ground level to act as a base. Guy wires 14 are attached from the ends of the base pole 12 to the vertical post 10 to prevent the post from tipping in a transverse direction (i.e. in the plane formed by post 10 and pole 12). The resulting ship's mast structure is difficult, cumbersome, awkward and time consuming to construct and set up. It also does not support the vertical post in a direction transverse to the base pole 12 prior to installation of utility wires on the post, and therefore the post is prone to tipping over until such wires are installed. Another recurrent problem is ground instability or shifting due to freeze/thaw cycles, during which the post 10 tends to shift, lean or fall since it is not anchored in a firm base. Hence, the ship's mast structure has significant drawbacks and is not very reliable, even though it is a popular mode of post support in muskegs.

Some prior patents, such as U.S. Pat. No. 5,066,168 (Holdeman) and U.S. Pat. No. 4,621,950 (Kinnan), disclose foundation devices for supporting posts, but which are not adapted for use in muskeg type of conditions and suffer from some of the following disadvantages. First, none of the prior devices are adapted for use both with and without an auger device for ground penetration, and therefore are not suitable for use in certain ground conditions. Second, the devices are not modularized, namely their lengths are fixed and can not be extended on-site to accommodate changing ground conditions. Length extendibility is desirable particularly in areas where the depth of suitable ground support strata is not known in advance and may be greater than expected. Simply manufacturing the prior art foundation devices longer is not feasible due to increased costs and wastage of material, and greater transportation and handling difficulties. Third, the prior devices employ a system of bolted plates at their top ends for transferring rotative drive from a drive machine to the device. These plate systems, although effective in transferring drive force, do not provide an easy and quick means of coupling/uncoupling the drive and the support device for enhanced installation efficiency. Further, the coupling plates obstruct or prevent escape of soil from within the support devices, which can hamper or prevent proper installation of the foundation device, particularly where the top of the foundation device must end up at or near ground level.

What is therefore desired is a novel device for supporting posts in muskegs and other like difficult ground support conditions, and which overcomes the limitations and disadvantages of prior support devices. Preferably it should provide for simple, quick and reliable coupling of the support device with any rotative drive means, and avoid obstructing any egress of ground material from within the support device during installation, nor manual removal of ground material thereafter for the subsequent insertion of a post therein. The support device should be suitable for use with or without an auger. Furthermore, the device should be capable of length variation, namely by coupling modular sections for length extension.

SUMMARY OF THE PRESENT INVENTION

According to the present invention, there is provided an apparatus for use with a rotatable drive means for providing ground support to a post member, said apparatus comprising:

- a generally cylindrical hollow pile having an open bottom end and an open top end for receiving said post member therein;
- said top end having slot means for releasably receiving said drive means to twist said pile about its longitudinal axis and to urge said pile into the ground; and,
- said bottom end having cutting means for cutting through the ground upon said twisting of the pile;
- wherein upon insertion of said pile into the ground with said drive means, a bottom portion of said post member is inserted into the top end of the pile and secured therein with filler material.

According to another embodiment of the invention, there is provided an assembly for anchoring a post in soil, for use with a rotatable powered drive shaft, said assembly comprising:

- a spinner bar element operatively engageable with said drive shaft;
- a hollow cylindrical casing with open top and bottom ends;
- said top end adapted to receive and retain said post, and having slot means for operatively engaging said spinner bar element to transfer rotation from said drive shaft to said casing for inserting and securing said casing in said soil; and,
- said bottom end having serrations for cutting through the soil during said rotation of the casing.

BRIEF DESCRIPTION OF THE DRAWING FIGURES

Embodiments of the invention will now be described, by way of example only, with reference to the accompanying drawings, wherein.

Figure 4A:
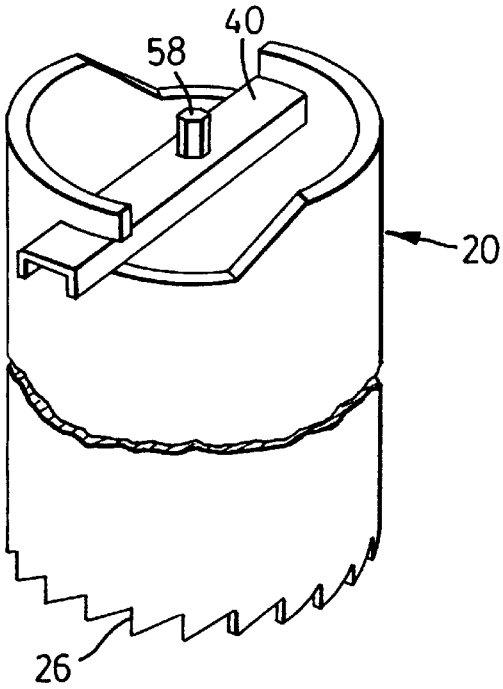
Figure 4B:
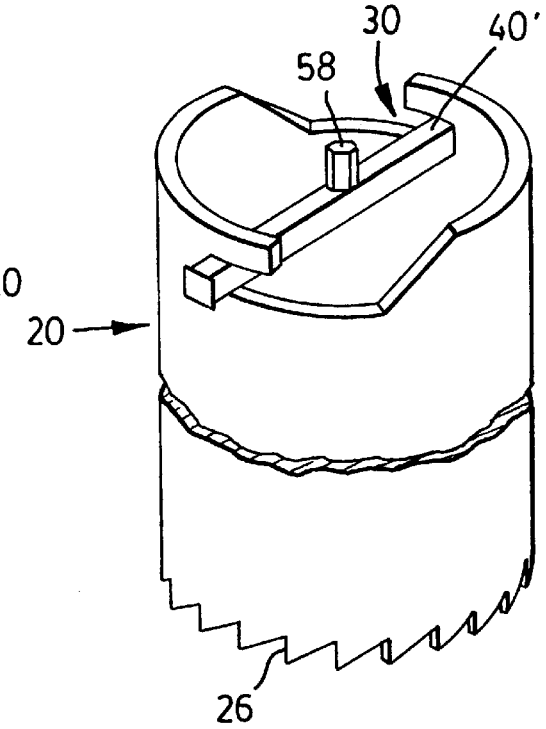
Figure 5:
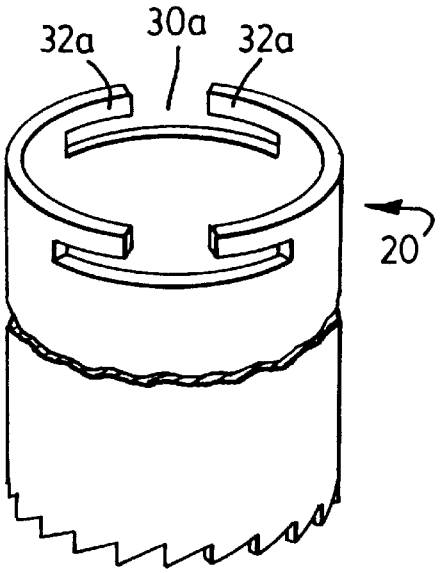
Figure 6:
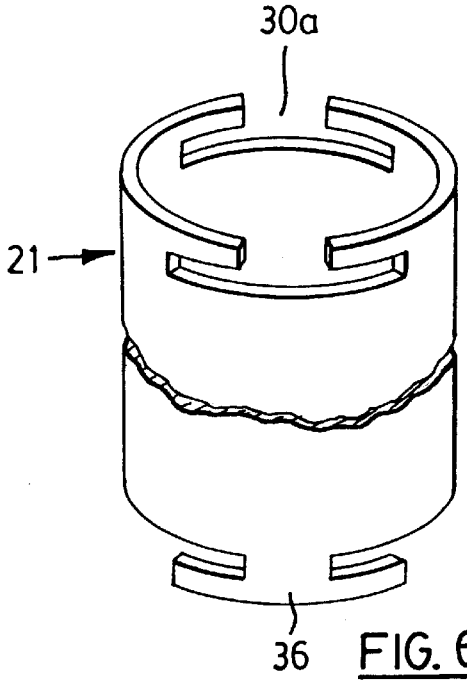
Figure 7A:
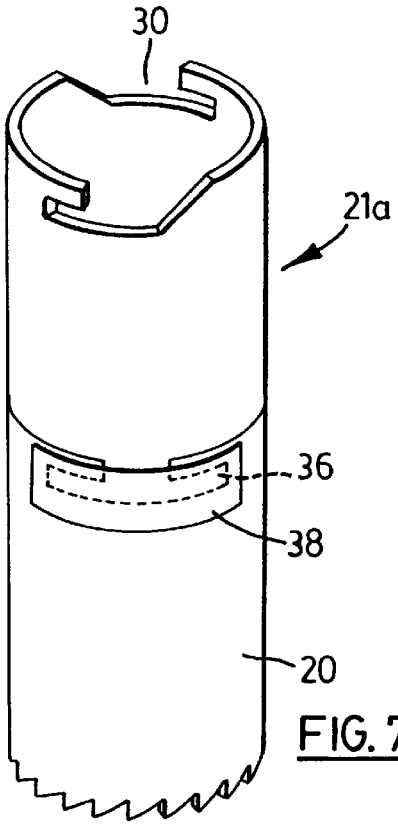
Figure 7B:
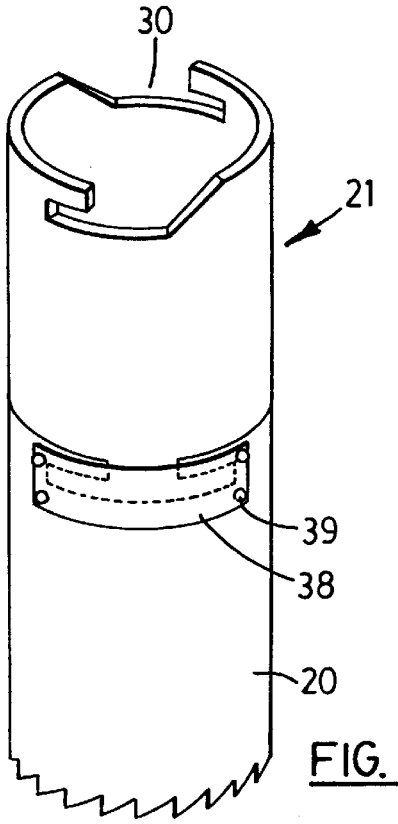
Figure 8:
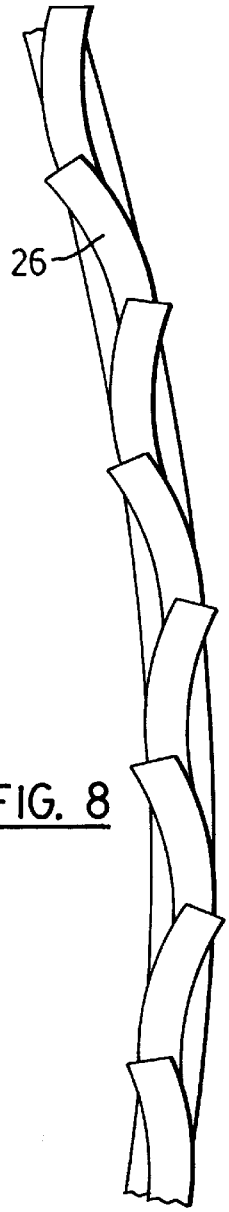
Figure 9:
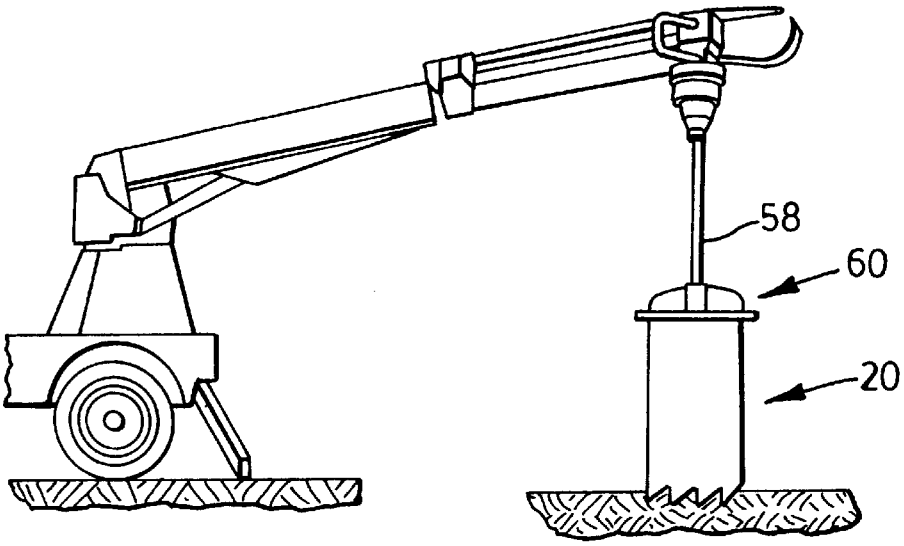
Figure 10:
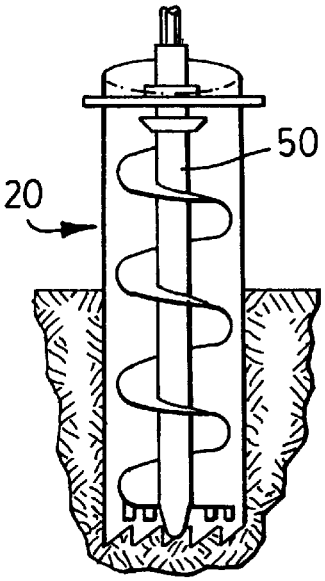
Figure 11:
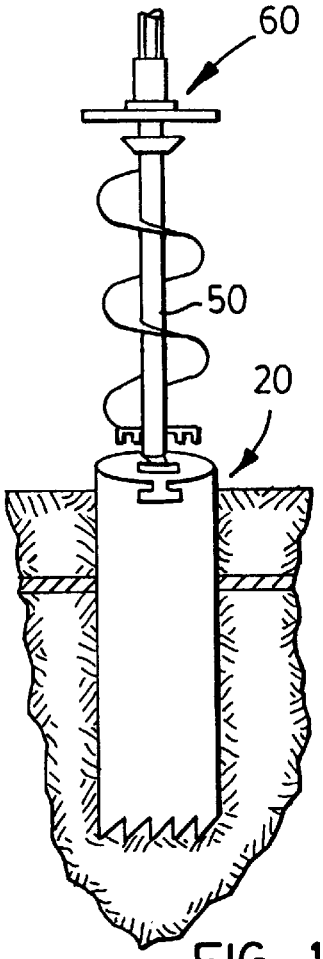
Figure 12:
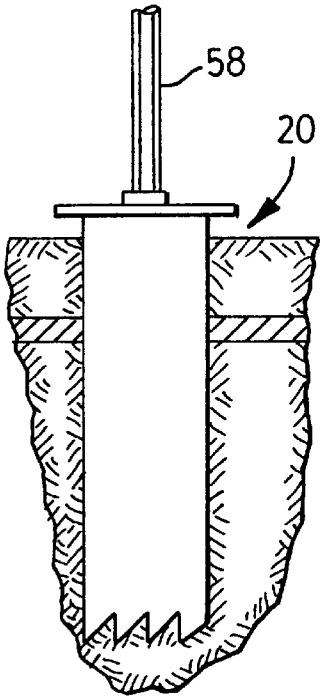

FIGS. 4 (*a*) and (*b*) are perspective views of the screw-in pile as connected to a channel iron spinning bar and a rectangular tubular spinning bar, respectively;

FIG. 5 is a perspective views of an alternate version of dog opening atop the screw-in pile;

FIG. 6 shows an extension pile according to another embodiment of the present invention;

FIGS. 7 (*a*) and (*b*) are perspective views of extended screw-in piles using an extension pile similar to that of FIG. 6 (i.e. an alternate version of the dog opening is shown) having a welded junction plate and a bolted junction plate, respectively;

FIG. 8 is a partial close-up end view of the kerfed serrations on a screw-in pile; and, FIGS. 9 to 12 show installation of the screw-in pile of the present invention using a rotary installation rig.

DESCRIPTION OF PREFERRED EMBODIMENTS

Figure 1:
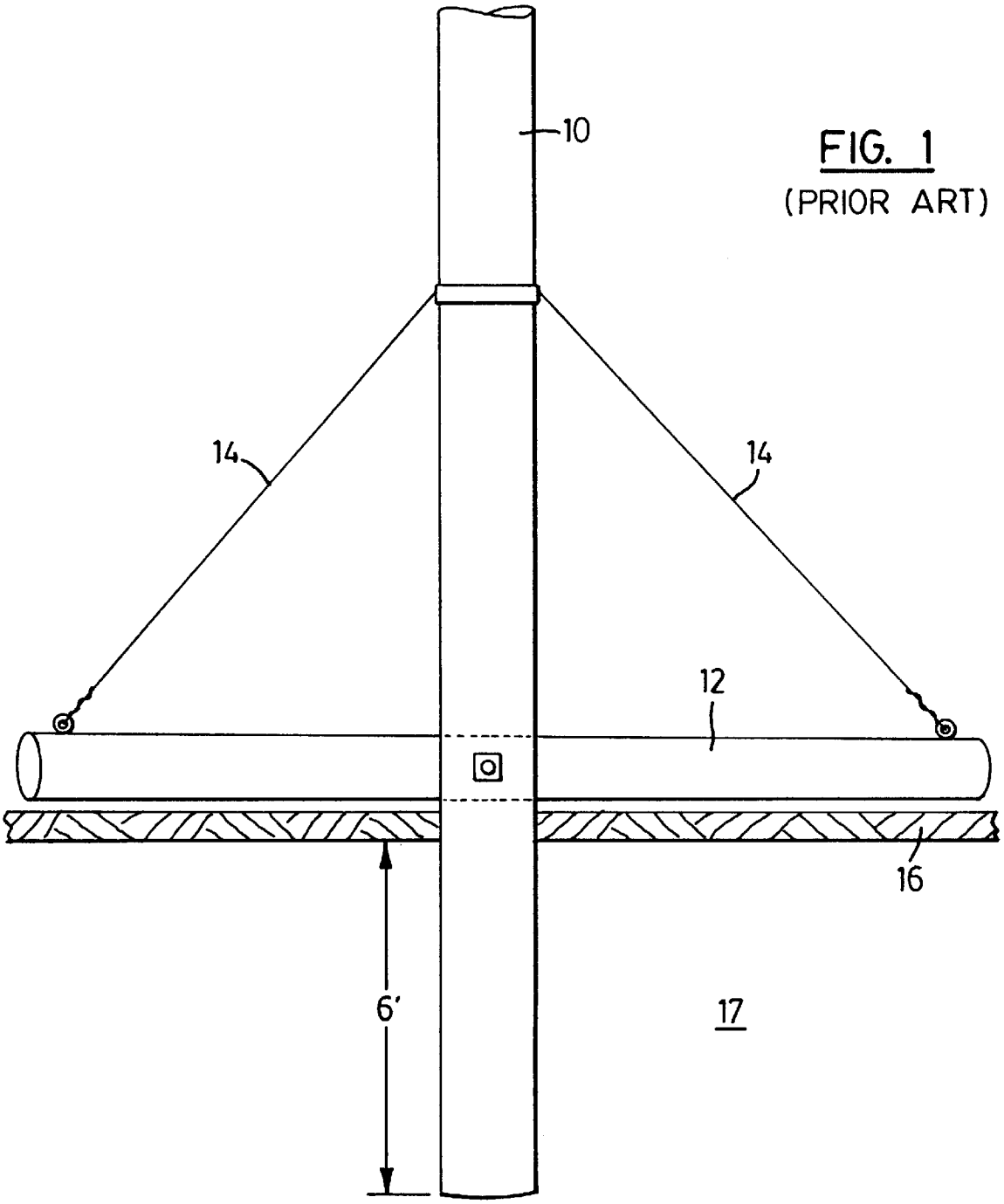
FIG. 1 (PRIOR ART)
FIG. 1 shows a prior art method of supporting a utility pole in muskeg, sometimes referred to as a "ship's mast"
Figure 2:
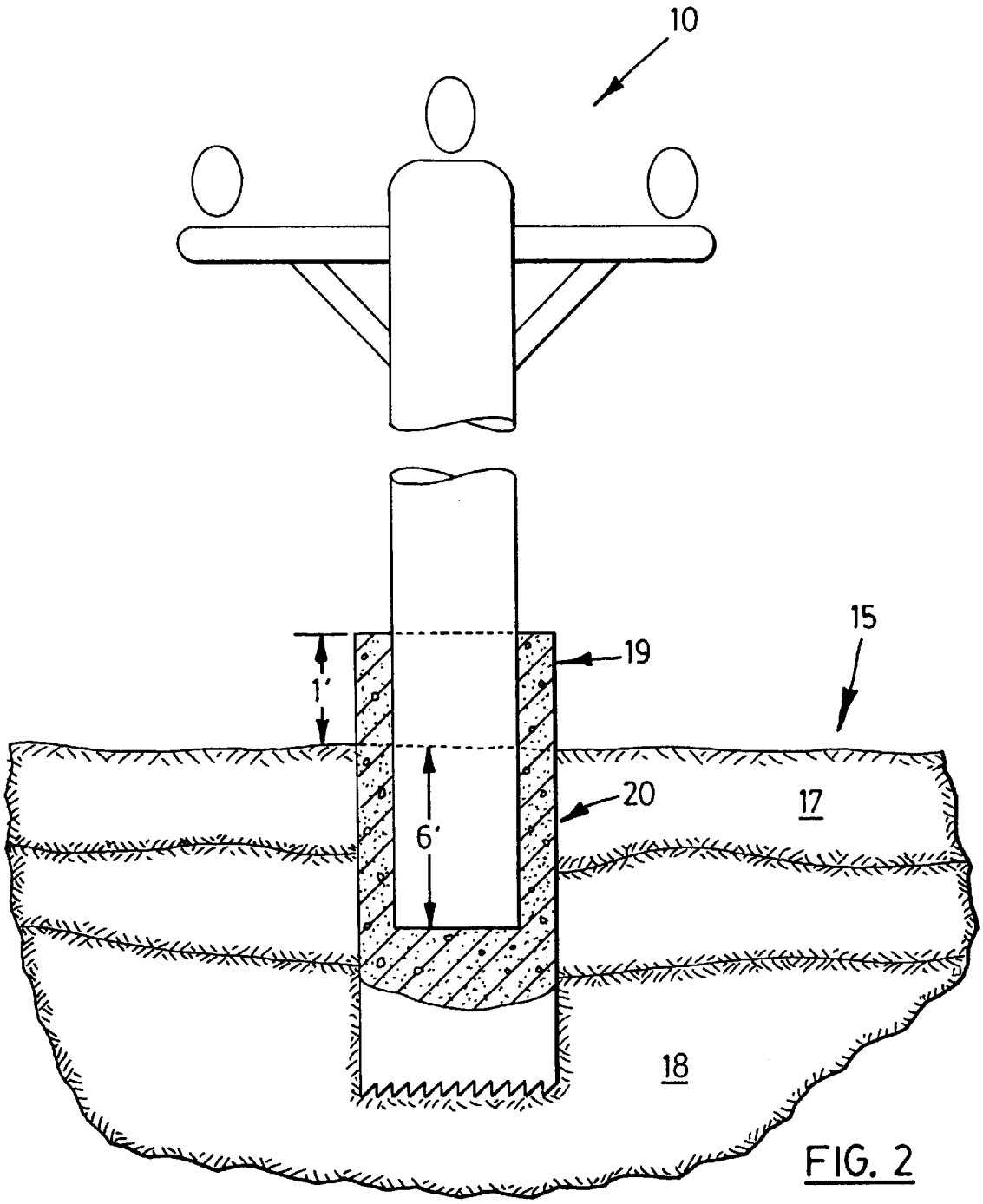
FIG. 2 is a general cut-away view of a screw-in pile according to one embodiment of the present invention supporting a utility pole in muskeg.

Reference is first made to FIG. 2 which shows a hollow screw-in pile according to the present invention (generally indicated by reference numeral 20) for supporting a utility post 10. The pile and post are located in a soil or ground base 15, which, for illustrative purposes, has a soft, marshy soil 17 overlying a relatively firmer layer of clay 18. Since such soft layers are typically inadequate for supporting utility posts, the screw-in pile is anchored in the clay 18, and the post is in turn supported within the pile by a blanket of compacted gravel 19 or other suitable material, as shown in FIG. 2 and described in greater detail later. It is understood that in certain circumstances the soil 17 may be firm enough to adequately anchor the pile, and so the pile need not reach a firmer underlying base.

Figure 3:
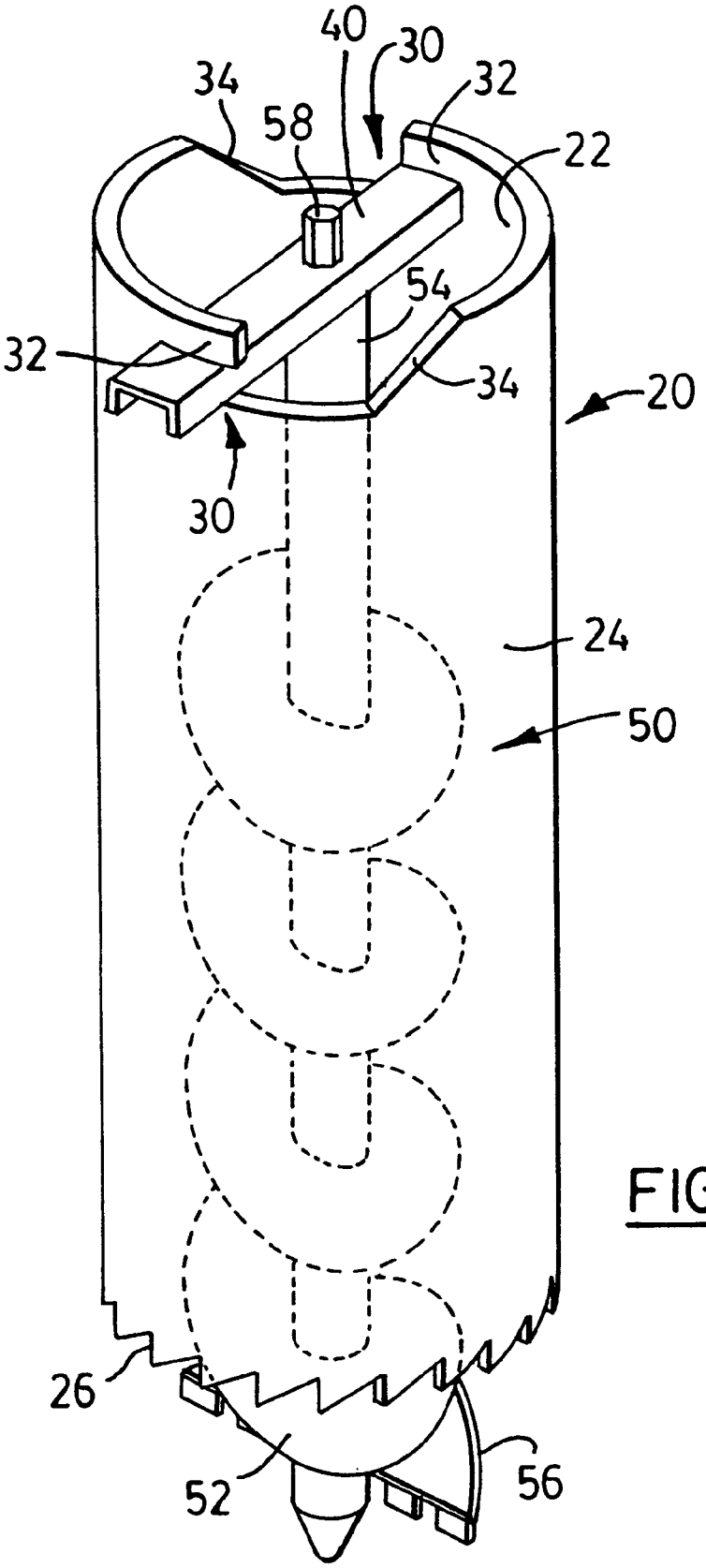
FIG. 3 is a perspective view from above of the screw-in pile in combination with an auger and a spinning bar.

Referring now to FIG. 3 as well, the pile 20 is in the form of an open ended, hollow cylindrical shell with inner and outer surfaces 22 and 24, respectively. The shell is preferably made of metal or other suitably strong material, and may be coated or otherwise treated with rust inhibiting agents. The outer surface is preferably smooth to reduce friction resistance during installation. The bottom end has serrations or teeth 26 for cutting through the ground material. In the FIG. 3 embodiment the teeth are arranged for a clockwise twisting of the pile during installation. The cutting action may be enhanced by kerfing the teeth (see FIG. 8), as discussed later.

The top end of the pile has a locking arrangement 28 for quickly and easily engaging and disengaging installation hardware and drive means which twist the pile about the longitudinal axis of the shell 20 and which may exert a downward pressure to urge the pile into the ground during such twisting. In the FIG. 3 embodiment the installation hardware includes a spinner bar 40 that supports an auger 50 which helps to pull the pile into the ground as the system is rotated. The auger 50 has a helical screw 52 supported on a shaft 54 which may have cutting lips 56 at the bottom for enhanced soil cutting action. The shaft 54 is generally aligned with the pile's longitudinal axis, and the screw 52 should be somewhat radially smaller than the pile's inner surface 22 to avoid jamming and excess frictional resistance, although the screw should be wide enough to remove a generous amount of soil from within the pile upon being lifted therefrom. The top end of the auger shaft 54 is engaged with the spinner bar 40 so that both the auger 50 and the pile 20 twist in unison. The bottom of the auger may be set to protrude from the pile's bottom end 26 (i.e. to "lead" the pile during installation as in FIG. 3) or to be recessed within the shell 20 (i.e. to "lag" the pile), depending on soil conditions.

The locking arrangement 28 consists of two radially opposed slots 30 cut out near the top end of the pile to form retainment dogs 32. The slots 30 must be wide enough so that the spinner bar 40 fits under the dogs 32 when it is pushed down and rotated clockwise to a fully engaged position as shown in FIG. 3. The dogs 32 prevent the spinner bar from disengaging the pile during use (i.e. clock-wise rotation), and allow the entire pile to be lifted by pulling upwardly on the spinner bar. The spinner bar is released and removed from the pile by rotating the bar in the opposite direction and lifting it away from the pile once it has cleared the dogs. Each slot 30 is provided with a guide ramp 34 opposite the dog 32 to facilitate insertion and removal of the spinner bar.

Both the auger 50 and spinner bar 40 are operatively connected to a drive shaft 58 (see FIGS. 9–12) for providing the above noted rotational and vertical forces. The drive shaft 58 may be driven by any rotary installation device, such as a hydraulic digger motor, having a hydraulic system to spin the pile assembly. The digger motor should be operable from any construction equipment, such as a back-hoe rig with a hydraulic system able to exert at least 10,000 ft-lb. of torque. An adapter 60, sometimes referred to a "kelly bar", is used to operatively connect and disconnect the spinner bar 40 from the drive shaft 58. The adapter allows the spinner bar to be moved along the drive shaft 58 independently of the auger, if need be.

FIGS. 4 (*a*) and (*b*) show another embodiment of the pile system, namely using the pile 20 and spinner bar 40 without employing an auger during installation of the pile itself. However, it will be understood that once the pile is set within the ground, an auger may then be used, if desired, to remove material from within the pile. FIG. 4(*a*) shows the same c-channel shaped spinner bar 40 as in FIG. 3, whereas FIG. 4(*b*) shows one of several possible alternate versions of the spinner bar $\mathbf{40}^1$, namely one made of a closed or box steel member with welded plates at its ends to prevent transverse dislocation from the slots 30.

FIG. 5 shows an alternate version of transverse slots 30 for the pile. In this configuration each slot 30*a* is formed by two circumferentially opposed dogs 32*a* and a central opening for inserting/removing a spinner bar. This version allows the pile to be rotated in both directions, and is used for modular extension of the pile as discussed next.

Referring now to FIGS. 6 and 7, FIG. 6 shows an extension unit 21 for the pile system of the present invention. For illustrative purposes, the top of the extension unit 21 employs the same slot 30*a* configuration as that of the pile of FIG. 5. The extension unit 21 differs from the previously discussed piles 20 in that the bottom of the extension unit substitutes a serrated edge with a pair of radially opposed-shaped lock members 36 (only one lock member shown). The lock members 36 are of the same size, shape and circumferential location as the retainment slots 30*a* so that the lock member 36 can be interlocked or interconnected with the slots 30*a* atop the pile 20 of FIG. 5, for instance. Hence, a pile of extended length is created where the slots 30*a* of the extension unit 21 are now used to engage a spinner bar for rotation of the entire extended pile. FIG. 7(*a*) shows such an extended pile where the extension unit 21*a* has been mounted atop and interlocked in longitudinal alignment with a pile 20. The two interlocked pile units are permanently joined together to avoid accidental dislocation by using a junction plate 38 which is either welded over the locking members 36 (FIG. 7(*a*)), or bolted onto the pile 20 with bolts 39 (FIG. 7(*b*)). FIG. 7 also illustrates that the locking members 36 of the extension unit 21*a* need only match the slots 30 of the pile 20 with which it is interlocked, and so the slots 22 atop the extension unit 21*a* may have a different configuration as desired.

FIG. 8 is a close up of a portion of the bottom end of a pile which shows the kurfed serrated teeth 26 that are generally part of the preferred embodiment. Kurfing (i.e. angling) the teeth has been found beneficial for installation in sandy ground, and may be omitted in mud or marshy ground conditions. Good results have been achieved by kerfing the teeth by about 5 degrees away from the plane of the pile shell in alternating directions as shown. The kerfed teeth appear to enhance the cutting action through the ground and to reduce skin friction between the pile's shell and the ground during installation. In addition, a tooth spacing of about 8 inches has been found to work well in gravel and sand conditions, particularly in the presence of large stones and the like which must be urged out of the way of an advancing pile.

It can now be better appreciated how the described pile system is installed and posts supported therein. Where it is desired to use an auger with the system, the auger and spinner bar are first mounted onto the drive shaft of the driver and then lowered into the pile 20. After engaging the spinner bar with the pile slots underneath the dogs, the entire assembly is lifted to the installation site and set in place. The drive shaft then transfers torque from the digger motor to the spinner bar and auger to begin screwing the pile into the ground (in a clockwise direction in the FIG. 3 embodiment, for example). The drive shaft should exert enough downward force, if any is required, to advance the pile into the ground, but not too much to avoid jamming the rotation. A slight upward force may be exerted on the pile through the spinner bar from time to time to jiggle the pile and urge stones or other obstructions out of the way of the pile's bottom serrated edge and the auger's leading edge. The pile should be sunk deep enough so that its bottom is solidly anchored in a clay base or other firm ground layer, and so that a portion of the pile's top end protrudes above-ground to avoid intrusion of surrounding soil into the pile (for example by one foot as shown in FIG. 2). The drive shaft is then rotated in an opposite direction (i.e. counterclockwise) to disengage the spinner bar from the slots, and is lifted to remove the spinner bar and auger. Removal of the auger will also lift some soil material from within the pile. Enough material should be removed from the pile to allow a sufficient length of post inside for support therein. Good results have been had with locating about 10% of the post's height, plus about 2 feet, within the pile (about 6 feet total in the FIG. 2 embodiment), although this may vary depending on the loads to be carried by the post, ground conditions, and the like. One should match pile and post sizes (i.e. diameters) so that there is a sufficient clearance between the post and inner surface of the pile (say about 3 to 4 inches minimum) to fit a tamper to compact the gravel material as it is placed between the post and pile. The post must obviously be supported by other means during this gravel placement.

The procedure for installing a pile without an auger is similar to that described above. It will be understood that an auger or other means may be used to remove material from within the pile once it is sunk in the ground.

In marshy conditions it may not be practical or possible to adequately remove the liquidy ground material from inside the pile with an auger. Hence, another option found to work well is to displace at least some of the liquidy material from within the pile by first dropping aggregates into the pile and pressing them to a desired level (say, six feet or so as discussed above), then inserting the post atop the aggregate, and finally by inserting and compacting more aggregate about the post as previously described. An adequate aggregate base should be provided to support the weight of the post.

Should extension units be required to reach a clay or other solid ground base, one or more extension units may be inserted onto and secured to a pile either prior to starting installation of the pile or after the pile is inserted part way into the ground.

Although not preferred, it will be appreciated that the pile of the present invention may also be installed, either in whole or in part, by pounding the pile into the ground using a pile driver as is customary in other current pile installation methods.

The above description is intended in an illustrative rather than a restrictive sense, and variations to the specific configurations described may be apparent to skilled persons in adapting the present invention to other specific applications. Such variations are intended to form part of the present invention insofar as they are within the spirit and scope of the claims below. For example, the number and size of teeth on the serrated edge 26 may be varied to adapt to different soil types. The shape and size of retainment dogs 32 may also be varied to adapt to different drive means and spinner bars.

We claim:

1. An apparatus for use with a rotatable drive means for providing ground support to a post member, said apparatus comprising:

a generally cylindrical hollow pile having an open bottom end and an open top end for receiving said post member therein;

said top end having slot means for releasably receiving said drive means to twist said pile about its longitudinal axis and to urge said pile into the ground;

said bottom end having cutting means for cutting through the ground upon said twisting of the pile; and, an auger member connectable to the drive means for rotation therewith, said auger member being located within said pile during installation thereof;

wherein upon insertion of said pile into the ground with said drive means, a bottom portion of said post member is inserted into the top end of the pile and secured therein with filler material.

2. The apparatus of claim 1 wherein said slot means comprises a pair of radially opposed slots formed adjacent said top end of the pile for slidably receiving said drive means therein, and said top end forming a protruding dog member adjacent each slot for preventing said drive means from lifting away from said pile during installation thereof.

3. The apparatus of claim 2 wherein each slot extends generally circumferentially along said pile, and each slot further includes an inclined ramp portion formed at said top end of the pile for guiding a spinner bar of said drive means into and out of the slot.

4. The apparatus of claim 3 wherein a substantial portion of said top end remains open to the ambient after said slots receive said spinner bar.

5. The apparatus of claim 1 wherein said cutting means comprises an edge of said bottom end of the pile having a plurality of serrations thereon.

6. The apparatus of claim 5 wherein said serrations are kerfed to enhance cutting of the ground and to reduce friction between said pile and ground during installation.

7. The apparatus of claim 6 wherein said serrations are kerfed by about 5 degrees in alternating directions toward and away from the longitudinal axis of the pile.

8. The apparatus of claim 1 wherein a bottom leading edge of said auger member extends beyond said bottom end of the pile during installation thereof.

9. The apparatus of claim 1 wherein a bottom leading edge of said auger member is located within said hollow pile during installation thereof.

10. The apparatus of claim 1 wherein said pile comprises first and second hollow cylindrical pile segments, each pile segment having an attachment means for interconnecting said pile segments in longitudinal alignment to form said pile.

11. The apparatus of claim 1 wherein a substantial portion of said top end remains open to the ambient after receiving said drive means.

12. An apparatus for use with a rotatable drive means for providing ground support to a post member, said apparatus comprising:

a generally cylindrical hollow pile having an open bottom end and an open top end for receiving said post member therein;

said top end having slot means for releasably receiving said drive means to twist said pile about its longitudinal axis and to urge said pile into the ground; and, said bottom end having cutting means for cutting through the ground upon said twisting of the pile;

said pile comprising first and second hollow cylindrical pile segments, each pile segment having an attachment means for interconnecting said pile segments in longitudinal alignment to form said pile; and said attachment means comprising meshable male and female lock members on abutting edges of said first and second pile segments, respectively, and junction means for retaining said first and second pile segments together upon mating said male and female lock members;

wherein upon insertion of said pile into the ground with said drive means, a bottom portion of said post member is inserted into the top end of the pile and secured therein with filler material.

13. The apparatus of claim 12 wherein said female lock member comprises a circumferential channel in said abutting edge of the first pile segment, and said male lock member comprises a t-shaped member protruding from said abutting edge of the second pile segment, and wherein said junction means comprises a plate for securing over said channel and t-shaped member when meshed.

14. An assembly for anchoring a post in soil, for use with a rotatable powered drive shaft, said assembly comprising:

a) a spinner bar element operatively engageable with said drive shaft;

b) a hollow cylindrical casing with open top and bottom ends;

c) said top end adapted to receive and retain said post, and having slot means for operatively engaging said spinner bar element to transfer rotation from said drive shaft to said casing for inserting and securing said casing in said soil;

d) said bottom end having serrations for cutting through the soil during said rotation of the casing; and e) an auger operatively engageable with said drive shaft for rotation therewith, said auger being located within said casing during installation thereof.

15. The assembly of claim 14 herein said slot means are adapted to slidably receive said spinner bar element.

16. The assembly of claim 14 wherein said spinner bar element is adapted to leave at least a portion of said top end unobstructed upon said spinner bar element engaging said slot means.

17. The assembly of claim 14 wherein said casing comprises at least two hollow cylindrical casing segments which are mated to form said casing.

* * * * *